US006760949B2

(12) United States Patent
Kaminstein et al.

(10) Patent No.: US 6,760,949 B2
(45) Date of Patent: Jul. 13, 2004

(54) ROTATING DISH BRUSH

(76) Inventors: Bruce Kaminstein, 400 Corporate Dr., Blauvelt, NY (US) 10913; Flavio Cavalherio, 400 Corporate Dr., Blauvelt, NY (US) 10913

( * ) Notice: Subject to any disclaimer, the term of this patent is extended or adjusted under 35 U.S.C. 154(b) by 75 days.

(21) Appl. No.: 10/234,587

(22) Filed: Sep. 4, 2002

(65) Prior Publication Data

US 2004/0040108 A1 Mar. 4, 2004

(51) Int. Cl.[7] ..... A46B 5/00; A47L 17/00
(52) U.S. Cl. ..... 15/164; 15/144.1; 15/172
(58) Field of Search ..... 15/144.1, 164, 15/172

(56) References Cited

U.S. PATENT DOCUMENTS

| | | | | | |
|---|---|---|---|---|---|
| 109,946 | A | * | 12/1870 | Rockwell et al. | 15/117 |
| 482,221 | A | * | 9/1892 | Barnett et al. | 403/96 |
| 882,021 | A | | 3/1908 | Schigelinsky | 15/211 |
| 1,083,829 | A | | 1/1914 | Hatosy, Jr. | 15/164 |
| 1,369,664 | A | * | 2/1921 | Riichiro | 15/167.1 |
| 1,882,576 | A | | 10/1932 | Hannaford | 15/104.9 |
| 2,584,503 | A | | 2/1952 | Schleenbaker | 15/164 |
| 2,727,267 | A | | 12/1955 | Osgood | 15/182 |
| 3,230,563 | A | | 1/1966 | Swanson | 15/164 |
| 3,704,479 | A | * | 12/1972 | Whitaker | 15/172 |
| 3,862,461 | A | | 1/1975 | Bucklitzch | 15/164 |
| 3,947,909 | A | | 4/1976 | Kuo | 15/23 |
| 4,763,377 | A | | 8/1988 | Madsen | 15/144.2 |
| 5,033,155 | A | | 7/1991 | Klotz | 15/211 |
| 5,317,779 | A | | 6/1994 | Hoagland | 15/111 |
| 5,319,824 | A | * | 6/1994 | Cook, III | 15/160 |
| 6,141,816 | A | | 11/2000 | Burnett | 15/164 |

* cited by examiner

*Primary Examiner*—Mark Spisich
(74) *Attorney, Agent, or Firm*—Stephen E. Feldman, P.C.

(57) ABSTRACT

A rotating dish brush is described having a handle and a head. The handle includes a neck connected by a pin to the head. The rotating connection of the handle and head are limited by a pair of stops that also function as areas of force transfer from the handle to the head. The stops limit the relative movement of the head and handle between a first position and a second position. The head includes a set of bristles having a generally hemispherical shape. A loop is provided on the handle for hanging the rotating dish brush when it is not in use.

20 Claims, 6 Drawing Sheets

ROTATING DISH BRUSH

BACKGROUND

1. Technical Field

The present disclosure relates to cleaning devices. More particularly, the present disclosure relates to cleaning devices for dishes having movable brushes.

2. Background of Related Art

Dish brushes have configurations that typically include an elongate handle connected to a bristled brush. The handle is often capable of bending and the brush has one or more sets of bristles extending in three dimensions enabling a user to clean any portion of an interior of a bottle, for example.

In U.S. Pat. No. 882,021 to Schigelinsky, a bottle cleaner is described having an elongate handle section connected to a cleaning section. Schigelinsky teaches a mechanism actuated from the handle for moving a tip of the bottle cleaner from a position aligned with the handle to a second position at a right angle to the handle. This feature enables the cleaning strip to be used for cleaning or scraping the sides of the bottle. While Schigelinsky provides for cleaning at a right angle relative to the handle, the ability to apply a cleaning force is limited by the length of the lever arm and the right angle application of the cleaning section. In addition, Schigelinsky limits the bottle cleaning section to being aligned with the handle or being at a right angle to the handle and therefore lacks the ability to apply a cleaning section through a range of angles relative to the handle.

A bottle brush having a pivoted handle is described in U.S. Pat. No. 2,584,503 to Schleenbaker and includes a body portion having a loose pivotal connection to a handle. The handle includes a bend in proximity to the body portion. The body portion has an elongate cylindrical tubular shape having a cut-out portion and includes two sets of bristles extending from U-shaped clips. A first set of bristles extend radially through an arc of approximately 270 degrees and the second set of bristles are generally aligned with the elongate tubular shape of the body portion and perpendicular to the first set of bristles.

In use, the body portion of Schleenbaker is pivoted to a first position wherein the bent portion of the handle is positioned partially within the cut away portion of the body and the elongate axis of the body assumes a substantially straight line with the handle. After positioning the body portion within the bottle, the body can be positioned using the movements of the handle to pivotally position the body between the First position and a second position wherein the body portion is generally perpendicular to the bent portion of the handle.

Schleenbaker, however, is limited by its force transfer configuration wherein, Schleenbaker relies on the transfer of force through a U-shaped clip functioning as an axle for the pivotal connection between the handle and the tubular body portion. Thus, the U-shaped clip, a point of rotation, is subject to both the frictional forces of rotation and a cleaning force from the handle. This configuration produces structural stresses such as shearing forces on the U-shaped clip by the tubular walls that are indicative of a cleaning device that is limited to applying light or superficial cleaning forces. Thus, the structural configuration Schleenbaker as shown is not suited for applying a broad range of cleaning force loads.

In U.S. Pat. No. 5,317,779 to Hoagland, a utility kitchen brush is described having a gently curved handle fixedly connected to a substantially rectangular bristle block. An array of bristles extends downward from die bristle block. A first scraper and a second scraper are positioned on the bristle block and define a notch. Hoagland, however, lacks the flexibility required for many cleaning applications by having a fixed handle to bristle block connection that does not permit the bristle block to accommodate variations in the surface to be cleaned without compensating by also moving the handle. This limits the application of Hoagland in a dimensionally constraining environment such as interior bottle cleaning. Thus, the flexibility in which Hoagland can be employed in cleaning processes is limited by the fixed relationship between the cleaning surface of the brush and scraper to the handle.

A continuing need exists for a rotating dish brush having a structure suitable for receiving a range of cleaning forces and a cleaning bead that can be rotated relative to the handle for employment of the brushing surface through an advantageously controlled range of angles.

SUMMARY

A rotating dish brush is described including a handle and a head. The handle has a distal end and a proximal end defining a longitudinal axis. The distal end of the handle defines a neck having a tip including a first planar surface connected with a second planar surface. The head has a generally spheroid shape with a first end opposing a second end. The second end is positioned on the neck and the first end has a single set of bristles. The bead is configured for rotation relative to the neck and defines a channel for receiving the neck aligned with the first longitudinal axis. The channel includes a channel planar surface configured for mating with the first planar surface and the second planar surface of the neck for the transfer of forces from the handle to the head.

The invention, together with attendant advantages, will be best understood by reference to the following detailed description of the invention when used in conjunction with the figures below.

BRIEF DESCRIPTION OF THE DRAWING

Preferred embodiments of the presently disclosed three position headpiece are described herein with reference to the drawings, wherein.

DESCRIPTION OF THE EMBODIMENTS

Figure 1:
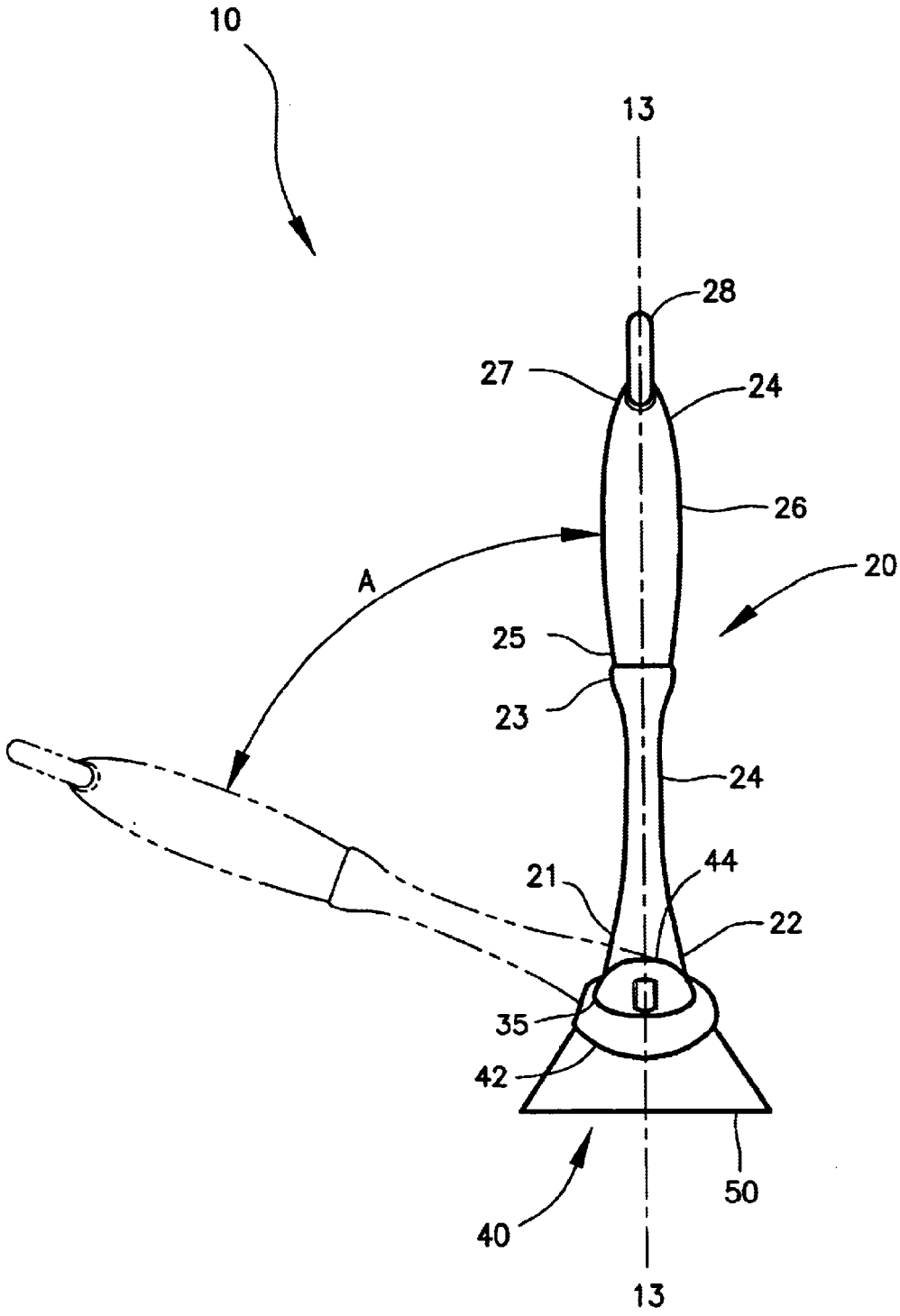
FIG. 1 is a side view of one preferred embodiment of the rotating dish brush constructed in accordance with the present disclosure with the bristles partially cut away.
Figure 2:
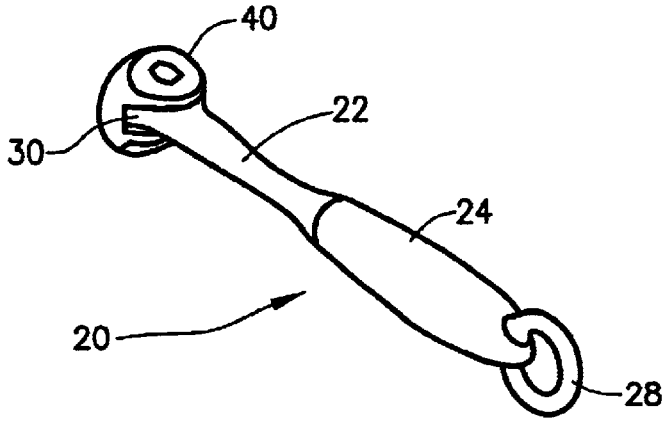
FIG. 2 is a forward perspective view of the rotating dish brush of FIG. 1 without any bristles depicted.

Referring now in specific detail to the drawings in which like referenced numerals identify similar or identical elements throughout the several views, and initially to FIGS. 1–2, a novel rotating dish brush 10 having a handle 20 and a head 40 is shown constructed in accordance with the present disclosure. Rotating dish brush 10, hereinafter referred to as "brush 10" is intended for use by a person as a scrubbing and/or cleaning dishes as well as other home related applications such as, but not limited to the cleaning of pots and pans, utensils, vehicular items, and other miscellaneous household items.

Handle 20 has a distal end portion 22 and a proximal end portion 24 defining a first longitudinal axis 13. Distal end portion 22 directly interfaces with head 40. Proximal end portion 24 is a handle. Handle 20 is generally configured as a rod having a varying diameter Distal end portion 22 has a distal end 21 and a proximal end 23. Proximal end 23 is connected to distal end 25 and distal end 21 includes a neck portion 30. In one preferred embodiment, distal end portion 22 narrows or necks at an approximate center point between ends 21 and 23.

Proximal end portion 24 has a tapered distal end 25 and a tapered proximal end 27 defining an ergonomically shaped grasping portion for a user. Proximal end 27 is connected to a fastening mechanism 28 suitable for suspending brush 10 from a hook, such as a loop for example. Fastener 28 can be rotate about a through hole defined in proximal end 27 or be fixedly connected to proximal end 27.

Head 40 includes a set of bristles 50 configured for washing, scrubbing, or scraping a surface. Head 40 includes a first end 42 and a second end 44 aligned having a primary angle of orientation of bristles 50. Bristles 50 extend from first end 42 in a radial pattern with the tips of the bristles defining a generally hemispherical surface. Bristles 50 can range from being soft and suitable for washing dishes such as plates or have sufficient structural integrity for scrubbing or scraping. Bristles 50 can also include mixes of differing types of bristles as well as have bristles 50 configured for non-stick surfaces and traditional metal surfaces. Second end 44 has a rotating connection to neck portion 30 for the application of bristles 50 about an axel or pin 35.

Handle 20 and head 40 can rotate independently of each other between a first position and a second position as shown by arrow-A. In the first position, bristles 50 have a primary orientation aligned with longitudinal axis 13. In the second position, handle 20 and/or head 40 have rotated approximately 60 degrees such that there is a 60 degree offset between the primary orientation of bristles 50 and first longitudinal axis 13 of handle 20.

Figure 3:
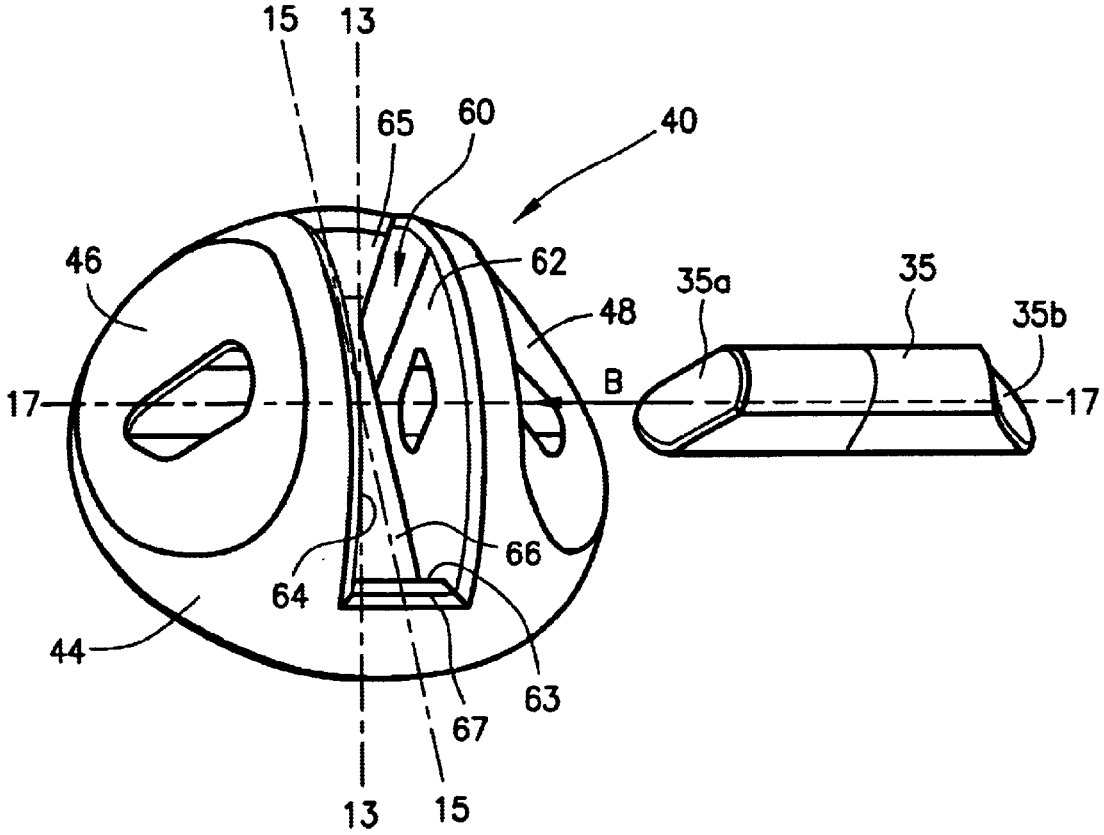
FIG. 3 is a perspective view of a head of the rotating dish brush of FIG. 1.

Referring now to FIG. 3, head 40 has a generally spheroid shape having an elliptical cross section about the first plane defined by first axis 13 and second axis 15. Second end 44 defines a channel 60 aligned with the first plane and having a generally rectangular cross section when viewed perpendicular to the first plane. Channel 60 has opposing walls 62 and 64 parallel to the first plane and opposing walls 63 and 65 along the perimeter of head 40. Channel 60 also defines a channel wall or a planar surface 66 positioned adjoining walls 62, 63, 64, and 65 as the distal most portion of the channel when brush 10 is in the first position. Planar surface 66 and the distal most edge of neck 30 are positioned as interfaces providing an advantageous surface area for force transfer between handle 20 and head 40.

Wall 65 has a first height and wall 63 has a second height such that wall 65 is preferably of greater length than the length of wall 63. Wall 63 has a tapered edge 67

Head 40 has two concave portions 46 and 48 opposing walls 62 and 64, respectively. A through hole B is defined through concave portions 46 and 48 as well as walls 62 and 64. Through hole B defines a third longitudinal axis 17 perpendicular to the first plane and is positioned as a point of rotation for handle 20. Head 40 also includes axel or pin 35 suitably configured for positioning within hole B and hole 31 of neck 30. Pin 35 has tapered ends 35*a* and 35*b* that are conformingly tapered to be flush with concave portions 46 and 48 when positioned in head 40.

Figure 4A:
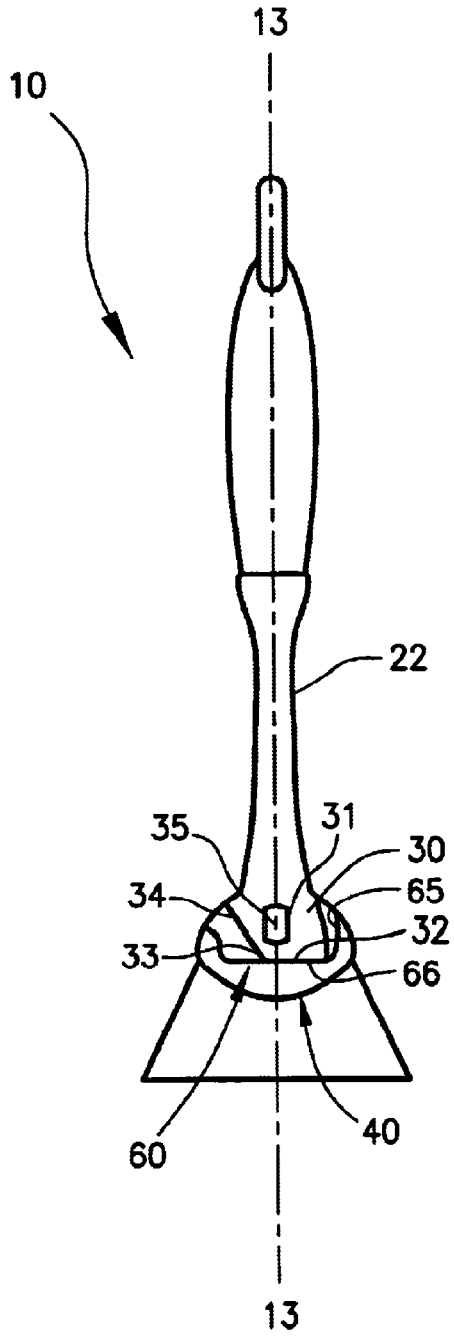
FIG. 4A is a cross-sectional side view of the rotating dish brush of FIG. 1 in a first position.
Figure 4B:
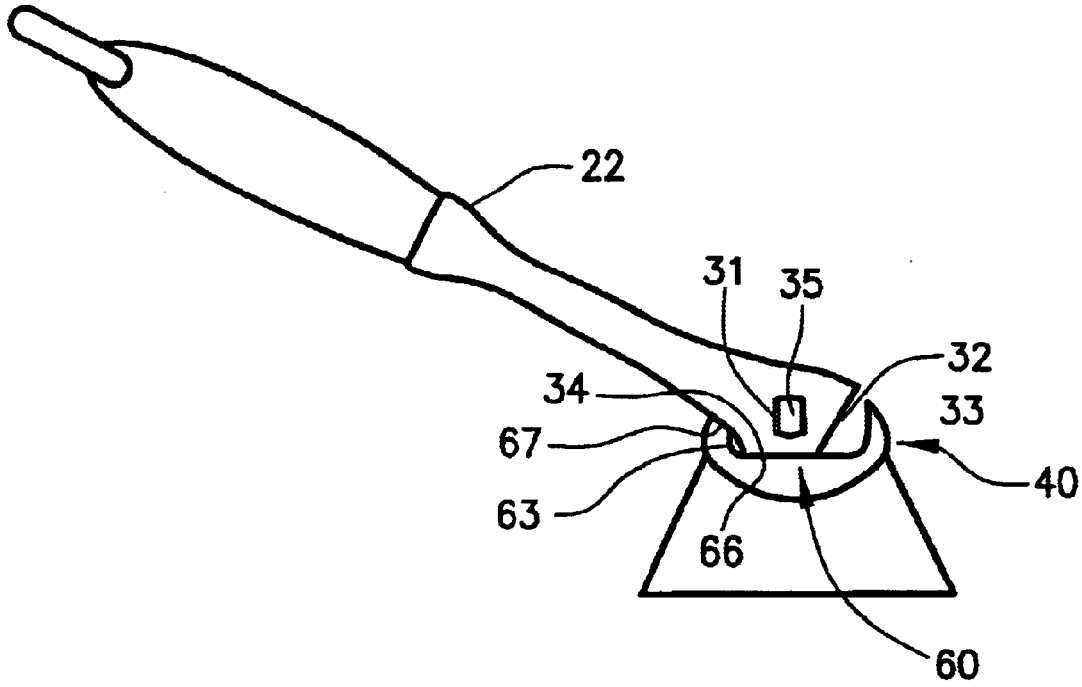
FIG. 4B is a cross-sectional side view of the rotating dish brush of FIG. 1 in a second position.

Referring now to FIGS. 4A and 4B, brush 10 is shown with neck 30 at least partially positioned in channel 60 of head 40 for rotation about axel 35. Neck portion 30 defines a first flat planar surface 32 connected by a rounded edge 33 to a second flat planar surface 34. First planar surface 32 is approximately perpendicular to first longitudinal axis 13 and second planar surface 34 places the relative position of handle 20 and head 40 approximately 60 degrees from the first position. The primary angle of orientation of bristles 50 is defined as being perpendicular to planar surface 66.

In the first position, a first planar surface 32 is positioned parallel to and in direct contact with planar surface 66 of head 40 and functions both as stop limiting the travel of handle 20 and a stable area for the transfer of forces from handle 20 to head 40. First surface 32 and channel wall 65 are not in contact and are positioned apart in the first position. Thus, wall 65 does not act as stop to limit the travel of handle 20 from rotating in the first plane.

In the second position a second planar surface 34 is positioned parallel to and in direct contact with planar surface 66 and functions as a stop limiting further movement of handle 20 relative to head 40 in cooperation with edge 67 of wall 63. Edge 67 is advantageously positioned as a second area for receiving the transfer of the cleaning force of the handle with planar surface 66 in the second position.

A rounded edge surface 33 enables a suitable transition between planar surfaces 32 and 34 and acts as an intermediate area of force transfer from handle 20 to head 40 between the first and second positions. Surfaces 32, 33, and 34 are force transfer areas cooperatively positioned in mating contact with surface 66 for the transfer of forces from handle 20 to bristles 50. Surfaces 32 and 34 are also positioned to functions as stops limiting the rotation between handle 20 and head 40 in the first and second positions, respectively.

While handle 10 and head 40 are described as having the ability to rotate up to approximately 60 degrees, it is readily envisioned that the application of varying handle geometries as well as head 40 and neck 30 configurations could accommodate rotating up to and in excess of 180 degrees.

Figure 5A:
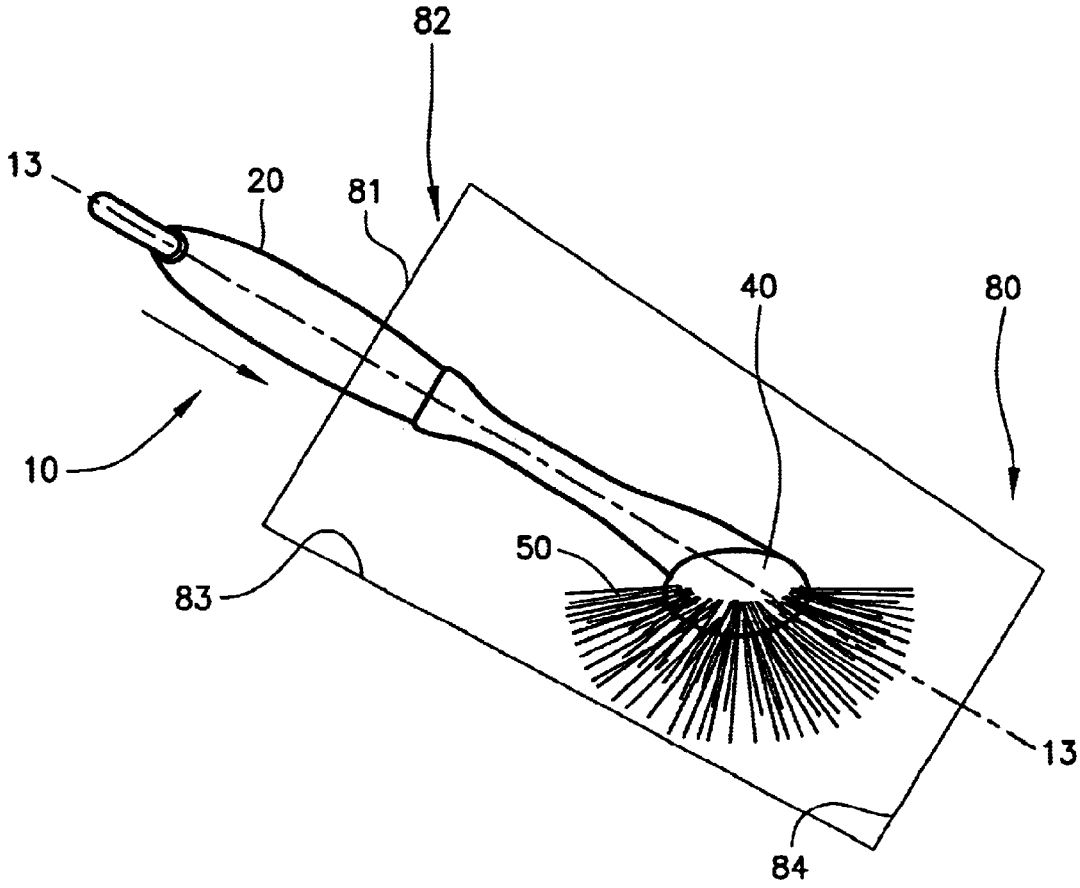
FIG. 5A is a side view of the rotating dish brash of FIG. 1 in the second position being positioned in and cleaning an inside wall of a drinking glass.
Figure 5B:
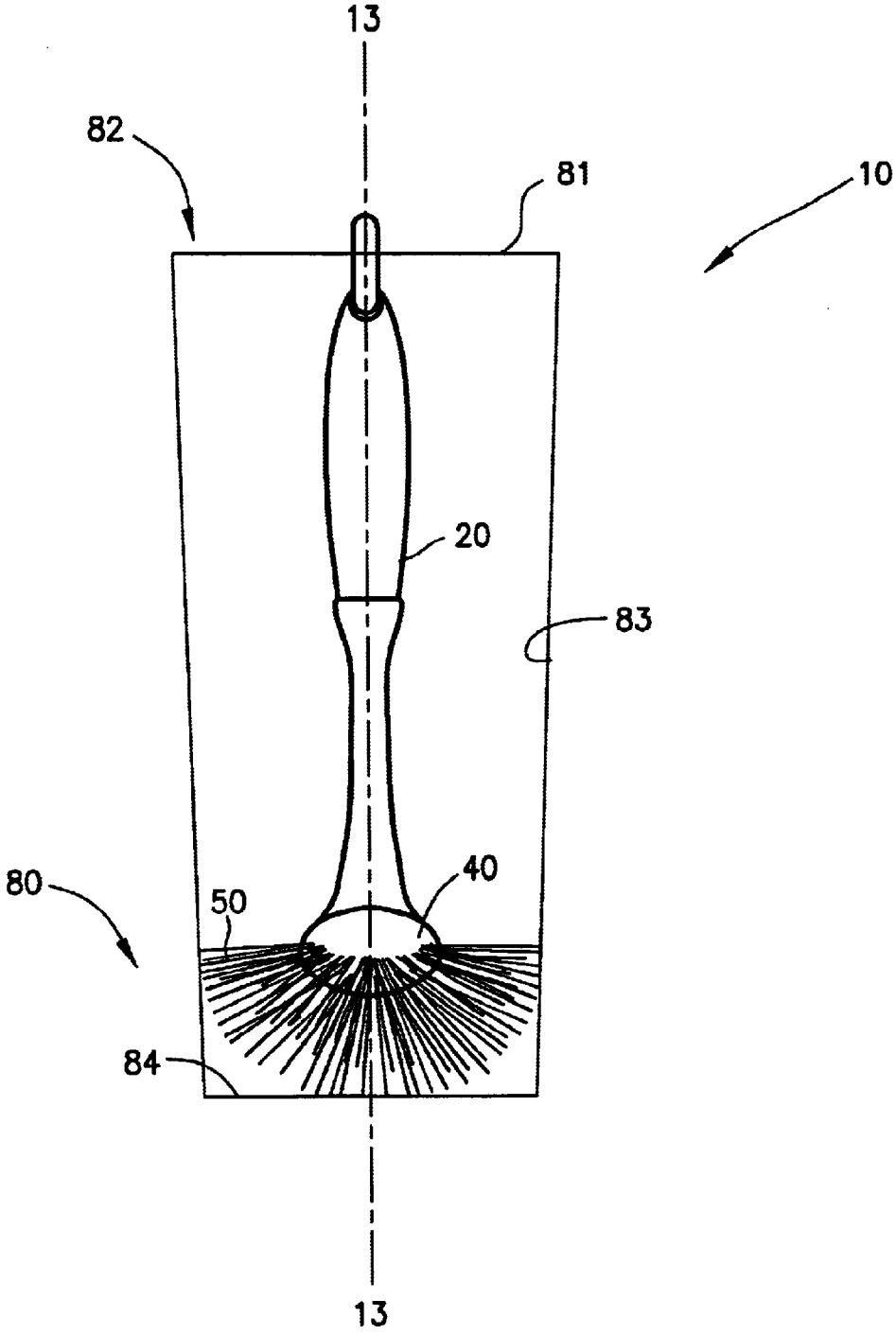
FIG. 5B is a side view of the rotating dish brush of FIG. 1 in the second position cleaning a bottom of the drinking glass.

Rotating dish brush 10 can be employed washing, scrubbing, or scraping items such as dishes as well as home or vehicular related products, but is illustrated in FIGS. 5A–5B in one preferred application in conjunction with washing common household glassware such as a drinking glass 80. Brush 10 is initially positioned for at least partially penetrating into an opening 82 defined by a lip 81 of glass 80. Head 40 is preferably in the second position when penetrating into opening 82 such that head 40 has a reduced frontal area when viewed from a cross-section perpendicular to longitudinal axis 13. The ability of brush 10 to enter glass 80 in the general direction of arrow-A, or any other opening, is limited only the geometry and dimensions of that opening relative to the dimensions of brush 10. Brush 10 is configured to be positioned through openings, such as opening 82, in any variation of angles between longitudinal axis 13 defined by handle 20 and head 40 throughout the complete range of approximately 60 degrees between the first position and the second position. Once head 40 is at least partially positioned within glass 80, bristles 50 can be positioned to contact an inside surface 83 of a cylindrical wall of glass 80.

The cleaning process with brush 10 preferably includes moving brush 10 in any direction or combination of directions including generally parallel, transverse, or rotated about longitudinal axis 13. Handle 20 can automatically adapt or change its relative angle to head 40 to accommodate variations in surface 83 within the range of movement between handle 20 and head 40. The user can also drive the change of relative angle between handle 20 and head 40 at their preference to increase the cleaning force component aligned with the angle of orientation of bristles 50, for example. Brush 10, at the convenience of the user is positioned approximately in the first position for cleaning of an inside bottom surface 84 of glass 80. The cleaning process of glass 80 is enhanced by the ability of the user to apply a strong cleaning force through handle 20 onto bristles 50 through the full range of approximately 60 degrees of brush 10. Brush 10 is withdrawn from glass 80 in the direction opposing arrow-A in any manner suitable for passage through opening 82.

The limiting of handle 20 in the second position to approximately 60 degrees from the first position advantageously keeps a sizeable component of the cleaning force along handle 20 applied along the primary angle of orientation of bristles 50. In addition the approximately 30 degree angle of handle 20 from the plane of application of the bristles in the second position combined with the dimensions of head 40 and the length of bristles 50 provides a stand-off to protect the fingers of the user from being inadvertently scraped during cleaning.

Although the illustrative embodiments of the present disclosure have been described herein with reference to the accompanying drawings, it is to be understood that the disclosure is not limited to those precise embodiments, and that various other changes and modifications may be affected therein by one skilled in the art without departing from the scope or spirit of the disclosure. All such changes and modifications are intended to be included within the scope of the disclosure.

What is claimed is:

1. A rotating dish brush comprising:

a handle having a distal end and a proximal end, the distal end and proximal end defining a longitudinal axis, the distal end of the handle including a neck having a tip with a first planar surface connected with a second planar surface; and a head having a generally spheroid shape and a first end opposing a second end, the second end being positioned on the neck of the handle and the first end including a single set of bristles, the head being rotatingly connected to the neck, the head defining a channel aligned with the longitudinal axis, the channel defining a channel planar surface configured for mating with the first planar surface and the second planar surface for the transfer of forces from the handle to the head.

2. The dish brush of claim 1, wherein the channel defines a wall having an edge, the wall being positioned to cooperatively limit the travel of the handle in a second position with the second planar surface and the channel planar surface.

3. The dish brush of claim 1, wherein the first planar surface and the second planar surface function as stops in combination with the channel planar surface limiting the rotation of the handle and head.

4. The dish brush of claim 1, wherein the bristles have ends, the ends defining a generally hemispherical surface.

5. The dish brush of claim 1, wherein the handle proximal end includes a fastening mechanism.

6. A dish brush having a head configured for rotating relative to a handle comprising:

a brush including a handle and a head, the handle having a distal end and a proximal end defining a first longitudinal axis, the head being pivotally connected to the distal end, the head having a first end including a single set of bristles and an opposing second end connected with the distal end of the handle, the bristles extending from the surface of the first end of the head and having a primary angle of orientation aligned with the first and second ends;

a first position wherein the handle and the bristles have a primary angle of orientation aligned with the first longitudinal axis, the first position being defined by a first planar surface of the distal end being parallel and in direct contact with a planar surface of the head; and a second position wherein the relative positions of the handle and the primary angle of orientation of the bristles has rotated to being approximately 60 degrees from being aligned with the first longitudinal axis, the second position being limited by a second planar surface of the distal end being in contact with the planar surface of the head, the handle and head being configured for rotation between the first and second position.

7. The dish brush of claim 6, wherein a neck is positioned on the distal end of the handle and a channel is defined in the head, the channel being configured solely for the positioning of the neck.

8. The dish brush of claim 6, wherein the handle includes an ergonomically shaped grip.

9. The dish brush of claim 6, wherein the bristles have ends, the ends defining a hemispherical surface.

10. The dish brush of clam 6, wherein the handle proximal end includes a fastening mechanism.

11. The dish brush of claim 6, wherein a pin connects the handle and the head and provides an axis of rotation.

12. A dish brush having a head configured for rotating relative to a handle comprising:

a handle having a distal end and a proximal end, the distal end and proximal end defining a longitudinal axis, the distal end having a first planar surface connected with a second planar surface, the first planar surface and the second planar surface defining force transfer areas and defining stops, the distal end defining a second longitudinal axis perpendicular to the first longitudinal axis, the first and second longitudinal axes defining a plane; and a head having a generally spheroid shape, the head having a first end opposing a second end, the second end being positioned on the distal end of the handle and the first end including a set of bristles, the head and handle being configured for rotation in the plane defined by the first longitudinal axis and the second longitudinal axis, the head defining a planar surface for force transfer from the first planar surface and the second planar surface of the handle, the first planar surface, second planar surface, and the head planar surface being configured to limit the relative rotation of the head and handle, the head defining a channel aligned with the plane, the channel being configured solely for accommodating the distal end of the handle.

13. The dish brush of claim 12, wherein the channel defines a wall having an edge, the wall being positioned to limit the travel of the handle in a second position in conjunction with the second planar surface and the head planar surface.

14. The dish brush of claim 12, wherein the second planar surface and the head planar surface function in combination as the sole limiting stops in a first position.

15. The dish brush of claim 12, wherein the bristles have ends, the ends defining a hemispherical surface.

16. The dish brush of clam 12, wherein the handle proximal end includes a fastening mechanism.

17. The dish brush of claim 12, wherein the handle includes an ergonomically shaped grip.

18. The dish brush of claim 12, wherein a pin connects the handle and the head and provides an axis of rotation.

19. The dish brush of claim 12, wherein the planar surface of the head is positioned in the channel.

20. The dish brush of claim 12, wherein the handle includes a neck, the neck having a tip defining the first planar surface and the second planar surface, the neck being connected to the second end of the head.

* * * * *

UNITED STATES PATENT AND TRADEMARK OFFICE

CERTIFICATE OF CORRECTION

PATENT NO. : 6,760,949 B2
DATED : July 13, 2004
INVENTOR(S) : Bruce Kaminstein et al.

It is certified that error appears in the above-identified patent and that said Letters Patent is hereby corrected as shown below:

Column 1,
Line 50, replace "First" with -- first --.

Column 4,
Line 27, add -- , -- after "position" but before "a second".

Column 5,
Line 14, add -- , -- after "user" but before "is".

Signed and Sealed this

Fourth Day of April, 2006

JON W. DUDAS
*Director of the United States Patent and Trademark Office*